US007216578B2

(12) United States Patent
Mentink

(10) Patent No.: US 7,216,578 B2
(45) Date of Patent: May 15, 2007

(54) HYDRAULIC ACTUATING DEVICE

(75) Inventor: Laurentius Andreas Gerardus Mentink, Haaksbergen (NL)

(73) Assignee: ActuanttCorporation, Glendale, WI (US)

( * ) Notice: Subject to any disclaimer, the term of this patent is extended or adjusted under 35 U.S.C. 154(b) by 10 days.

(21) Appl. No.: 11/147,898

(22) Filed: Jun. 8, 2005

(65) Prior Publication Data

US 2005/0276709 A1 Dec. 15, 2005

(30) Foreign Application Priority Data

Jun. 11, 2004 (NL) ..... 1026393

(51) Int. Cl.
*F15B 11/044* (2006.01)
*F15B 13/00* (2006.01)

(52) U.S. Cl. ..... 91/421; 91/433; 91/465

(58) Field of Classification Search ..... 91/418, 91/420, 421, 433, 465
See application file for complete search history.

(56) References Cited

U.S. PATENT DOCUMENTS

| | | | | |
|---|---|---|---|---|
| 3,656,294 | A * | 4/1972 | Praddaude | 91/420 |
| 4,531,449 | A * | 7/1985 | Reith | 91/420 |
| 4,838,306 | A * | 6/1989 | Horn et al. | 91/420 |
| 6,848,641 | B2 * | 2/2005 | Lohmann et al. | 91/420 |
| 6,871,574 | B2 * | 3/2005 | Barber | 91/420 |
| 2003/0201355 | A1 | 10/2003 | Lohmann et al. | |
| 2004/0237773 | A1 | 12/2004 | Mentink | |

FOREIGN PATENT DOCUMENTS

| | | | |
|---|---|---|---|
| DE | 10253340 | A1 | 11/2003 |
| DE | 10253871 | B3 | 8/2004 |
| EP | 1052127 | B1 | 11/2000 |
| NL | 1023573 | C2 | 12/2004 |
| NL | 1023583 | C2 | 12/2004 |

* cited by examiner

*Primary Examiner*—Thomas E. Lazo
(74) *Attorney, Agent, or Firm*—Quarles & Brady LLP

(57) ABSTRACT

The invention relates to a hydraulic actuating device for a movable component of a vehicle, in particular a closure element for closing an opening in a vehicle body, such as for example a movable roof, such as a folding roof or a retractable hard top. The hydraulic actuating device according to the invention has hydraulic actuating means for driving a first control valve assembly, which hydraulic actuating means comprise at least one hydraulic control connection which is in communication with a second connection of a hydraulic actuator, and which hydraulic actuating means are designed to ensure that, when a first hydraulic pressure is present at the second connection, which first hydraulic pressure is the consequence of a connection being formed between the second connection and a pressure port of a pump, a first connection of the actuator is connected to a reservoir, and that when a second hydraulic pressure is present at the second connection, which second hydraulic pressure is the consequence of a connection being formed between the second connection and the reservoir, the first connection is connected to the pressure port of the pump.

12 Claims, 3 Drawing Sheets

HYDRAULIC ACTUATING DEVICE

BACKGROUND OF THE INVENTION

The invention relates to a hydraulic actuating device for a movable component of a vehicle, in particular a closure element for closing an opening in a vehicle body, such as for example a movable roof, such as a folding roof or a retractable hard top.

The applicant is aware of a hydraulic actuating device as shown in FIGS. 1*a* and 1*b*.

FIG. 1*a* shows a hydraulic actuating device comprises an actuator 1, with the first working chamber 6 being in communication, via a first connection 4 and a first connecting line 15, with pressure port 11 of pump 10. A second working chamber 7 is connected to a second connecting line 16 via a second connection 5. In this connecting line 16 there is a control valve assembly 19. This control valve assembly 19 ensures that the second working chamber 7 can be connected either to the pressure port 11 of the pump 10 or to a reservoir 12. The control valve assembly 19 is driven by a control device 50.

If, in the known hydraulic actuating device shown in FIG. 1*a*, it is desired to retract piston rod 3 of the hydraulic actuator 1, the control device 50 switches the control valve assembly 19 in such a manner that the second connecting line 16 connects the second working chamber 7 of the actuator 1 to the reservoir 12. However, if it is desired to extend the piston rod 3, the control device 50 has to switch the control valve assembly 19 in such a manner that the connecting line 16 connects the second working chamber 7 to the pressure port 11 of the pump 10. It can be seen from FIG. 1*a* that the pressure which is applied by the pump 10 in that situation acts on both sides of piston 2 of actuator 1. On account of the difference in active surface area of the two sides of the piston 2, which difference is caused by the presence of piston rod 3, a low resulting force remains, allowing the piston to move in such a manner that the piston rod 3 is extended.

One significant drawback of this hydraulic actuating device is that the resulting force with which the piston rod is extended is low, since during the extension the pressure acting on the piston on the piston rod side counteracts the pressure acting on the piston from the base side. The effective surface area of the piston on which the hydraulic pressure acts is therefore limited, when the piston rod is being extended, to a surface area equal to that of the cross section of the piston rod.

To overcome this drawback, it has in the past been proposed that a control valve assembly 18 identical to the control valve assembly which is present in the second connecting line also be incorporated in the first connecting line as is shown in FIG. 1*b*. This control valve assembly 18 is driven by control device 50. However, this makes the actuating device more expensive and more complex to drive. A hydraulic actuating device of this type is known, for example, from EP 1052127.

SUMMARY OF THE INVENTION

It is an object of the invention to provide a hydraulic actuating device which is simple to drive and can also deliver a high force when extending the piston rod.

The invention achieves this object by means of a hydraulic actuating device comprising a hydraulic actuator having a first connection and a second connection, a piston, a first working chamber, which is in communication with the first connection, a second working chamber, which is in communication with the second connection. Furthermore the hydraulic actuating device comprises a pump having a pressure port for delivering a pressurized hydraulic fluid, and a reservoir for hydraulic fluid. A first connecting line is leading from the pressure port of the pump to the first connection of the hydraulic actuator. A second connecting line is leading from the pressure port of the pump to the second connection of the hydraulic actuator. The device according to the invention also comprises a first control valve assembly and a second control valve assembly. The first control valve assembly is located in the first connection line and has a port leading to the first connection, a port leading to the pressure port of the pump and a port leading to the reservoir. The second control valve assembly is located in the second connection line and has a port leading to the second connection, a port leading to the pressure port of the pump and a port leading to the reservoir. The second control valve assembly is coupled to a control device for switching the second control valve assembly on command between a first position, in which the second connection is connected to the pressure port, and a second position, in which the second connection is connected to the reservoir. According to the invention only the second control valve assembly is coupled to said control device. Furthermore, the first control valve assembly is provided with hydraulic actuating means, which hydraulic actuating means comprise at least one hydraulic control connection, which is in communication with the second connection of the hydraulic actuator. The hydraulic actuating means are designed to ensure that when a first hydraulic pressure is present at the second connection—which first hydraulic pressure is the consequence of a connection being formed between the second connection and the pressure port—the first connection is connected to the reservoir, and that when a second hydraulic pressure is present at the second connection—which second hydraulic pressure is the consequence of a connection being formed between the second connection and the reservoir—the first connection is connected to the pressure port of the pump.

The presence of a first control valve assembly and a second control valve assembly in the hydraulic actuating device according to the invention ensures that in each case one of the working chambers is in communication with the pump and the other working chamber is in communication with the reservoir. As a result, in one of the working chambers the pressure is in each case at least virtually equal to the pressure in the reservoir, which pressure is considerably lower than the pressure which is delivered by the pump (the pressure which prevails in the reservoir is typically 1 atmosphere). The reservoir pressure will therefore deliver scarcely any force on the piston which counteracts the piston movement caused by the pressure delivered by the pump.

The result of this measure is that the force which the actuator can deliver can be utilized entirely to extend the piston rod.

In the hydraulic actuating device according to the invention, use is made of the hydraulic pressure prevailing in the second connecting line in order to drive the first control valve assembly. This hydraulic pressure, which is either (at least virtually) equal to the pressure in the reservoir or (at least virtually) equal to the pressure which is applied by the pump, during use is always present in the hydraulic actuating device. As a result, there is no need to provide for separate driving of the first control valve assembly by the control device of the hydraulic actuating device.

In a first advantageous embodiment, the first control valve assembly is designed in such a way that it comprises a switching element which determines whether the first connection is connected to the pressure port of the pump or to the reservoir. In this embodiment, this switching element has a primary position and a secondary position. When no force is being exerted on the switching element, the switching element is in its primary position. An external force can move the switching element into its secondary position. As long as the external force continues to be present, the switching element is in its secondary position. If the external force is eliminated, restoring means which are provided in the first control valve assembly move the switching element back into its primary position. These restoring means preferably comprise a spring, more preferably a compression spring.

In this first advantageous embodiment, the external force is delivered by the hydraulic actuating means of the first control valve assembly by virtue of the switching element being provided with a surface on which a hydraulic pressure can be exerted. The hydraulic control connection (which forms part of the hydraulic actuating means) in this embodiment ensures that the pressure prevailing in the second connecting line acts on the said surface of the switching element. With a high pressure in the second connecting line—which high pressure occurs when the second connection is in communication with the pressure port of the pump—this pressure ensures that the switching element is moved into and held in its secondary position, counter to the force of the restoring means. If the second control valve assembly is switched to its second position, in which the second connection is connected to the reservoir, the pressure in the second connecting line drops to approximately the level of the pressure in the reservoir, and the restoring means move the switching element back into its primary position and hold the switching element in that position.

The hydraulic actuator preferably comprises a single piston rod. However, it is also possible to use a continuous piston rod.

In a second advantageous embodiment, the first control valve assembly comprises a displaceable switching element and a first and second seat for the switching element. When the switching element is in the first seat, the first connection is connected to the reservoir. When the switching element is in the second seat, the first connection is connected to the pressure port of the pump.

In this second embodiment, the hydraulic actuating means also comprise a control cylinder with a control piston and a primary connection, which primary connection is connected to the hydraulic control connection, and an actuating element which is designed to be driven by the control piston, for actuating the switching element as a function of the position of the control piston.

When, in this second embodiment, the first (i.e. high) pressure prevails in the second connecting line, this second pressure also acts on the control piston, with the result that the latter is displaced. The control piston is connected to an actuating element which moves with the control piston. This actuating element acts on the switching element, in such a manner that the switching element moves into the first seat. As a result, the first connection and the pressure port of the pump are disconnected and the first connection and the reservoir are connected.

If the pressure in the second connecting line then drops because the second control valve assembly is switched to its second position, restoring means move the control piston back together with the actuating means and the switching element, in such a manner that the switching element moves into the second seat. As a result, the first connection and reservoir are disconnected and the first connection and pressure port of the pump are connected.

The switching element is preferably a ball.

The actuating element is preferably a piston rod.

In a further advantageous embodiment, the first control valve assembly comprises a first valve and a second valve. The hydraulic actuating means comprise a first control unit for actuating the first valve and a second control unit for actuating the second valve. The first valve has a first primary port leading to the first connecting line and a first secondary port leading to the reservoir. The second valve has a second primary port leading to the first connecting line and a second secondary port leading to the pressure port.

When a first hydraulic pressure prevails in the second connecting line, the first valve is open and the second valve closed, so that the first connection of the hydraulic actuator is in communication with the reservoir. When a second hydraulic pressure prevails in the second connecting line, the first valve is closed and the second valve open, so that the first connection of the hydraulic actuator is in communication with the pressure port.

It is preferable for both the first and second valves to be nonreturn valves.

In an advantageous variant of the third embodiment, the first valve comprises a first switching element, and the second valve comprises a second switching element. In this variant, the hydraulic actuating means include a first control unit for operating the first valve and a second control unit for operating the second valve. At least one of the control units comprises:

- a control cylinder having a control piston and a primary connection,
- an actuating element which is designed to be driven by the control piston, for actuating the switching element of the associated valve as a function of the position of the control piston, a hydraulic control connection forming a connection between the primary connection and the second connecting line.

Hydraulic actuating devices in various embodiments of the invention will be explained in more detail below with reference to the appended drawing, which shows non-limiting exemplary embodiments.

DETAILED DESCRIPTION OF THE PREFERRED EMBODIMENTS

Figure 1A:
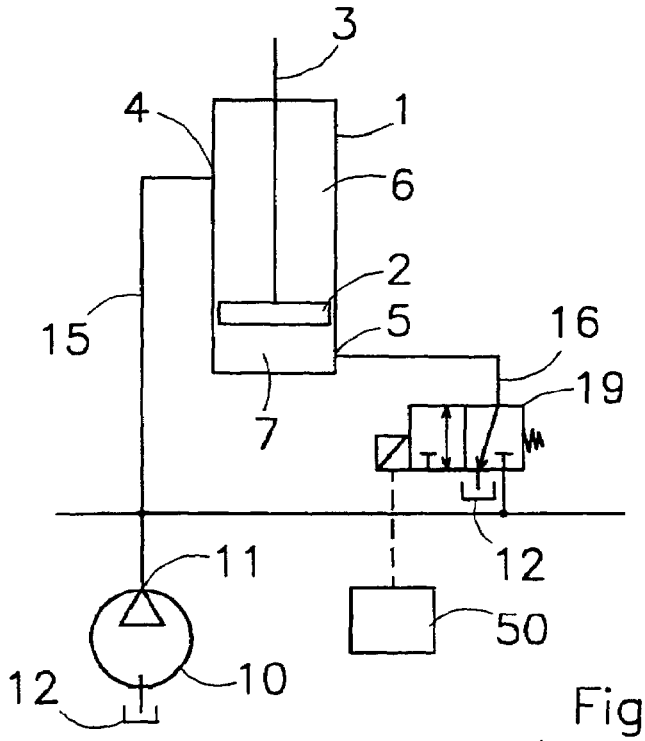
Fig 1A (PRIOR ART)
FIG. 1*a–b* shows hydraulic actuating devices which are known from the prior art.
Figure 1B:
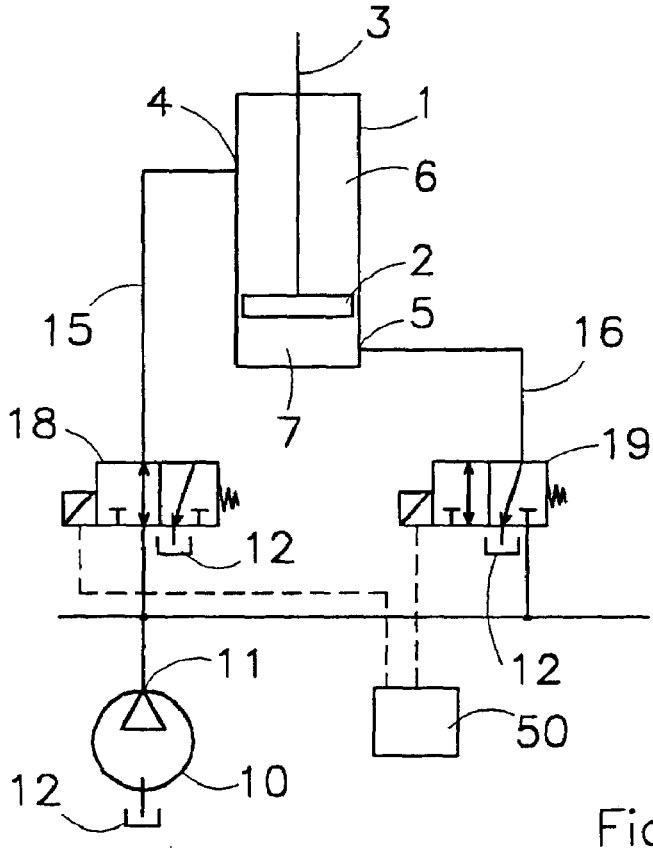
Fig 1B (PRIOR ART)
Figure 2:
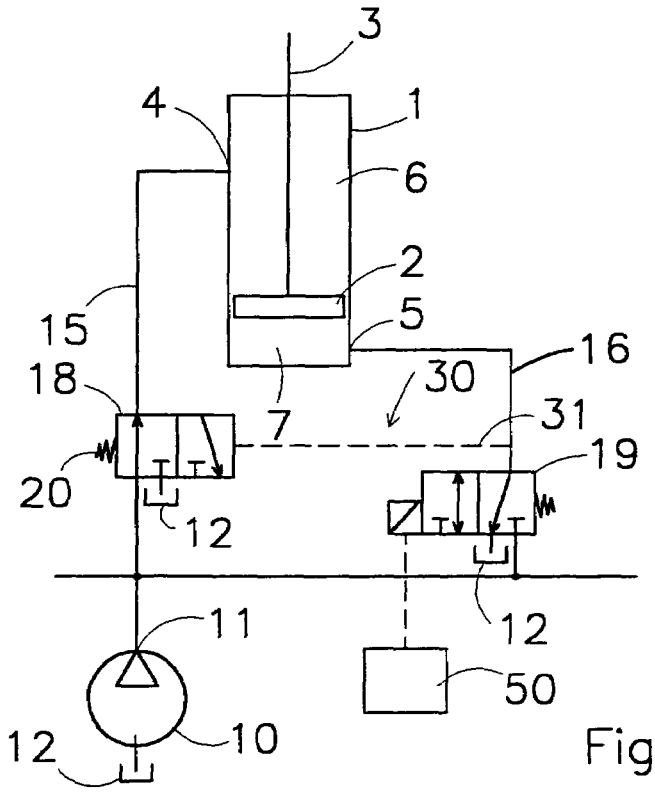
FIG. 2 shows a first embodiment of the hydraulic actuating device according to the invention.

FIG. 2 shows a first embodiment of the hydraulic actuating device according to the invention. This hydraulic actuating device, in addition to the elements which were already known from the hydraulic actuating device according to the prior art, comprises a first control valve assembly 18, which is arranged in the first connecting line 15 connecting the first connection 4 of the actuator 1 to the pressure port 11 of the pump 10 or to the reservoir 12, depending on the position of the first control valve assembly 18. The hydraulic actuating device is set up in such a way that in each case one control valve assembly 18, 19 realizes a connection to the pressure port 11 of pump 10, and the other control valve assembly 18, 19 realizes a connection to the reservoir 12. This prevents the pressure delivered by the pump 10 from acting on both sides of the piston 2 of the actuator 1, which would lead to only a low resulting force displacing the piston 2 with the piston rod 3.

To prevent control of the hydraulic actuating device from becoming unnecessarily complex, in the hydraulic actuating device according to the invention there are hydraulic actuating means 30 for driving the first control valve assembly 18. In the embodiment shown in FIG. 2, these hydraulic actuating means 30 comprise a hydraulic control connection 31. Such a control is sometimes in the art called a pilot line. This hydraulic control connection 31 is coupled to the second connecting line 16, so that the pressure in the hydraulic control connection 31 is the same as in the second connecting line 16. The pressure which prevails in the control connection 31 can exert an external force on the first control valve assembly 18, by means of which the first control valve assembly 18 is actuated.

In the embodiment shown in FIG. 2, this is specifically realized by allowing the hydraulic pressure to act on an active surface of a switching element from the control valve assembly 18. This switching element determines whether the first connection 4 of the actuator 1 is in communication with the pump 10 or the reservoir 12. A restoring means 20 also acts on the switching element. A restoring means 20 of this type may be designed as a compression spring. The force delivered by the restoring means 20 on the switching element is selected to be such that when the pressure applied by the pump 10 prevails in the second connecting line 16, and therefore in the hydraulic control device 31, the force which is delivered by this hydraulic pressure is greater than the force which is delivered by the restoring means 20. However, if the pressure which results from the second connection 5 being connected to the reservoir 12 prevails in the second connecting line 16 and therefore in the hydraulic control connection 31, the force which is delivered by the restoring means 20 is higher than the force which is caused by the pressure in the hydraulic control connection 31.

It will therefore be clear to the person skilled in the art that a further advantage of the hydraulic actuating device according to the invention in general (i.e. not specifically in this embodiment) is that it is no longer necessary to create a difference in active surface area between the two sides of the piston 2 of the hydraulic actuator. In specific terms, this means that in the hydraulic actuating device according to the invention, it would also be possible for a continuous piston rod to be used in the actuator 1.

Figure 3:
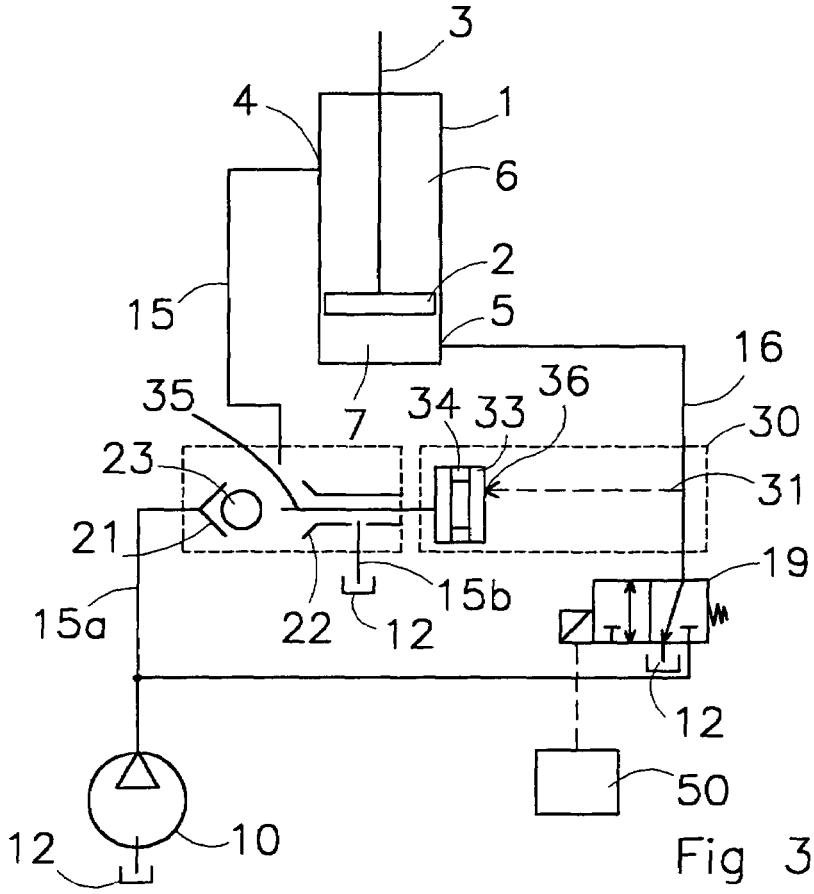
FIG. 3 shows a second embodiment of the hydraulic actuating device according to the invention.

FIG. 3 shows a second advantageous embodiment of the hydraulic actuating device according to the invention. The difference from the embodiment shown in FIG. 2 lies in particular in the structure of the first control valve assembly 18. In the embodiment shown in FIG. 3, the first control valve assembly 18 comprises a displaceable switching element 23, which is preferably designed as a ball. The first control valve assembly 18 also includes a first seat 21 and a second seat 22. These seats 21, 22 for the switching element 23 are designed in such a manner that when the switching element 23 is in one of the seats 21, 22, the connecting line 15 which is connected to the corresponding seat 21, 22 is closed off by the switching element 23. In the example shown in FIG. 3, the first seat 21 is connected to the first line part 15*a* of the first connecting line 15, which first line part 15*a* is connected to the pressure port 11 of pump 10. A second part 15*b* of the first connecting line 15 is connected to the reservoir 12. When the switching element 23 is in the first seat, line part 15*a* is blocked and hydraulic fluid can flow from the first connection 4 to the reservoir 12. When the switching element 23 is in the second seat 22, the path to the reservoir 12 is closed. The hydraulic fluid can then flow from the pressure port of the pump 11 to the first connection 4.

To actuate the switching element 23, in the embodiment shown in FIG. 3 there is an actuating element 35 which is driven by a control cylinder 33. This control cylinder 33 is provided with a primary connection 36, to which the hydraulic control connection 31 is connected. When the high pressure applied by the pump prevails in the second connection line 16 and therefore in the hydraulic control connection 31, the piston of the control cylinder 33 is pushed away by this hydraulic pressure, so that the actuating element 35 presses the switching element 33 into the first seat. However, if the pressure in the second connecting line 16 becomes low as a result of the second connection of the hydraulic actuator 1 being connected to the reservoir 12, restoring means (not shown) move the piston 34 of the control cylinder 33 back towards the primary connection 36. As a result, the actuating element 35 brings the switching element 23 with it, specifically in such a manner that the switching element 23 moves into the second seat 22.

This second embodiment likewise means that the control device 50 of the hydraulic actuating device has only to drive the second control valve assembly 19. After all, the first control valve assembly 18 is driven by the hydraulic pressure prevailing in the second connecting line 16.

Figure 4:
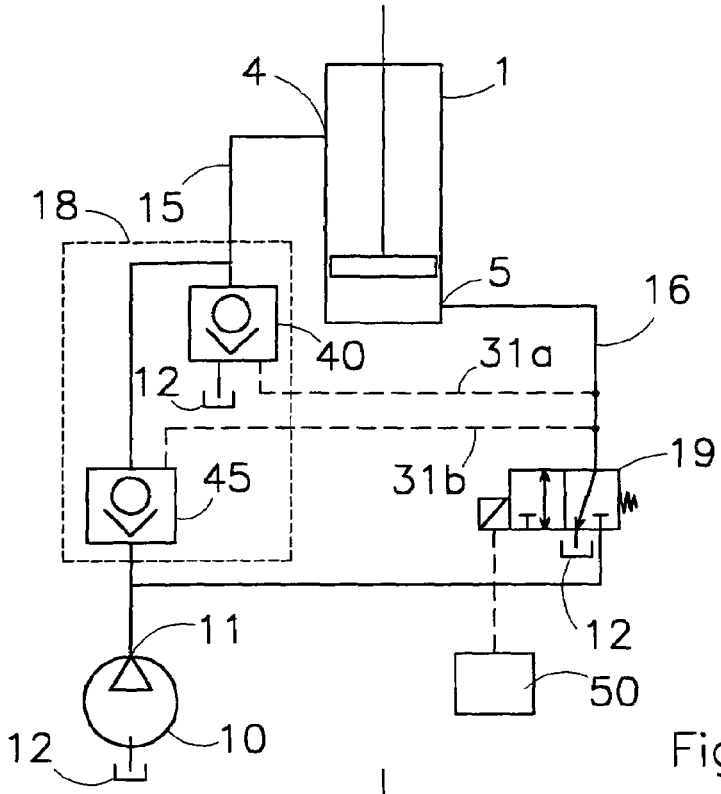
FIG. 4 shows a third embodiment of the hydraulic actuating device according to the invention.

FIG. 4 shows a third advantageous embodiment of the hydraulic actuating device according to the invention. In the embodiment shown in FIG. 4, the hydraulic actuating device comprises a first valve 40 and a second valve 45. The first valve 40 has a first primary port leading to the first connecting line 15 and a first secondary port leading to the reservoir 12. The second valve 45 has a second primary port leading to the first connecting line 15 and a second secondary port leading to the pressure port 11 of pump 10. The valves 40, 45 are each driven by a dedicated control connection 31*a*, 31*b*. The hydraulic actuating means 30, of which the hydraulic control connections 31*a* and 31*b* form part, are designed in such a way that when a hydraulic pressure applied by the pump 10 prevails in the second connecting line 16 the first valve 40 is open and the second valve 45 is closed. As a result, hydraulic fluid flows from the first connection 4 of the hydraulic actuator 1 to the reservoir 12. However, if a low hydraulic pressure prevails in the second connecting line 16, as a result of the second connection 5 of the actuator 1 being connected to the reservoir 12, the hydraulic actuating means 30 ensure that the first valve 40 is closed and the second valve 45 is open. As a result, hydraulic fluid can be passed from the pump 10 to the first connection 4 of the actuator 1.

The two valves 40, 45 can be designed as nonreturn valves.

Figure 5:
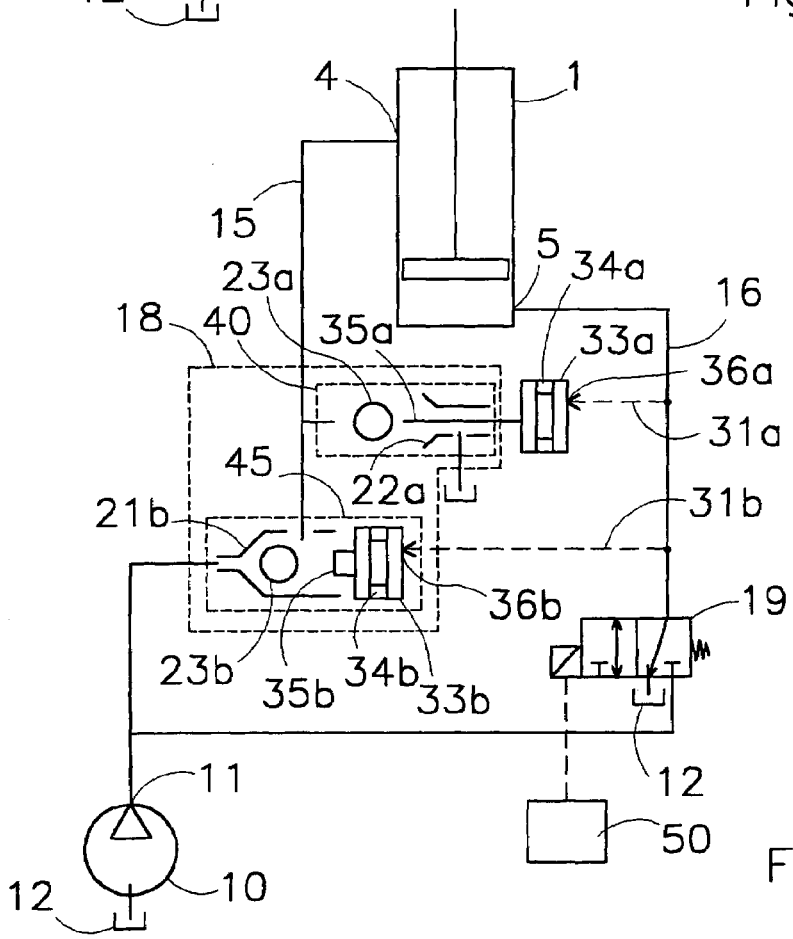
FIG. 5 shows a variant of the third embodiment as shown in FIG. 4.

FIG. 5 shows an advantageous variant of the embodiment shown in FIG. 4. In the embodiment shown in FIG. 5, the first valve 40 comprises a first switching element 23*a*. This first switching element 23*a* is actuated by control cylinder 33*a* via an actuating element 45*a*. This control cylinder 33*a* is connected to a hydraulic control connection 31*a*, which is in open communication with the second connecting line 16. The first valve 40 closes the passage of fluid from the first connection 4 to the reservoir 12 when the switching element 23*a* is moved into seat 22*a* by the actuating element 35*a*. This occurs when the pressure in the second connecting line 16 is low. In that case, piston 34*b* of control cylinder 33*b* also moves towards the primary connection 36*b*. As a result, switching element 23*b* is moved out of the seat 21*b* by actuating element 35*b*. This realizes a through connection between the pressure port 11 of pump 10 and the first connection 4 of the hydraulic actuator 1.

When the pressure in the second connecting line is relatively high, which is caused by a connection being created between the pressure port 11 of the pump 10 and the second connection 5 of the actuator 1, the two pistons 34*a*, 34*b* of the control cylinders 33*a*, 33*b* move away from their primary connections 36*a*, 36*b*. The consequence of this is that the first switching element 23*a* is pressed out of its seat 22*a*, and that the second switching element 23*b* is pressed into its seat 21*b*. As a result, the first connection 4 and the pressure port 11 of the pump 10 are disconnected, and the first connection 4 and the reservoir 12 are connected.

What is claimed is:

1. A hydraulic actuating device for a movable component of a vehicle, in particular a closure element for closing an opening in a vehicle body, comprising:

a hydraulic actuator having a first connection and a second connection, a piston, a first working chamber, which is in communication with the first connection, a second working chamber, which is in communication with the second connection, a pump having a pressure port for delivering a pressurized hydraulic fluid, a reservoir for hydraulic fluid, a first connecting line leading from the pressure port of the pump to the first connection of the hydraulic actuator, a second connecting line leading from the pressure port of the pump to the second connection of the hydraulic actuator, a first control valve assembly, which is located in the first connection line and has a port leading to the first connection, a port leading to the pressure port of the pump and a port leading to the reservoir, a second control valve assembly, which is located in the second connection line and has a port leading to the second connection, a port leading to the pressure port of the pump and a port leading to the reservoir, the second control valve assembly being coupled to a control device for switching the second control valve assembly on command between a first position in which the second connection is connected to the pressure port and a second position, in which the second connection is connected to the reservoir, wherein only the second control valve assembly is coupled to said control device, and wherein the first control valve assembly is provided with hydraulic actuating means, which hydraulic actuating means comprise at least one hydraulic control connection, which is in permanent communication with the second connection of the hydraulic actuator, the hydraulic actuating means being designed to ensure that when a first hydraulic pressure is present at the second connection—which first hydraulic pressure is the consequence of a connection being formed between the second connection and the pressure port—the first connection is connected to the reservoir, and that when a second hydraulic pressure is present at the second connection—which second hydraulic pressure is the consequence of a connection being formed between the second connection and the reservoir—the first connection is connected to the pressure port of the pump.

2. The hydraulic actuating device according to claim 1, wherein the first control valve assembly comprises a switching element, which switching element can be displaced between a primary position and a secondary position, which switching element has an active surface, on which, during operation, the hydraulic pressure from the second connecting line acts via the hydraulic control line, and wherein the first control valve assembly comprises restoring means which are designed to deliver a force to the switching element, in such a manner that the balance between the force which is delivered by the restoring means and the force which is delivered by the hydraulic pressure on the active surface of the switching element determines whether the switching element is in the primary position or the secondary position.

3. The hydraulic actuating device according to claim 2, wherein the restoring means comprise a spring.

4. The hydraulic actuating device according to claim 1, wherein the actuator comprises a piston rod, an end of which is secured to the piston, and wherein the first working chamber is located on the same side of the piston as the piston rod.

5. The hydraulic actuating device according to claim 1, wherein the first control valve assembly comprises a displaceable switching element, as well as a first seat and a second seat for the switching element, the switching element, when it is in the first seat, connecting the first connection to the reservoir and, when it is in the second seat, connecting the first connection to the pressure port, and wherein the hydraulic actuating means also comprise:

a control cylinder having a control piston and a primary connection, which primary connection is connected to the hydraulic control connection, an actuating element which is designed to be driven by the control piston in order to actuate the switching element as a function of the position of the control piston.

6. The hydraulic actuating device according to claim 5, wherein the switching element is a ball.

7. The hydraulic actuating device according to claim 5, wherein the actuating element is a piston rod which is connected to the control piston.

8. The hydraulic actuating device according to claim 1, wherein the first control valve assembly comprises a first valve and a second valve, and wherein the hydraulic actuating means comprise a first control unit for actuating the first valve and a second control unit for actuating the second valve, the first valve having a first primary port leading to the first connecting line and a first secondary port leading to the reservoir, and the second valve having a secondary primary port leading to the first connecting line and a second secondary port leading to the pressure port, wherein when a first hydraulic pressure prevails in the second connecting line, the first valve is open and the second valve is closed, so that the first connection of the hydraulic actuator is in communication with the reservoir, and wherein when a second hydraulic pressure prevails in the second connecting line, the first valve is closed and the second valve is open, so that the first connection of the hydraulic actuator is in communication with the pressure port.

9. The hydraulic actuating device according to claim 8, wherein both the first valve and the second valve are non-return valves.

10. The hydraulic actuating device according to claim 8, wherein the first valve comprises a first switching element, and the second valve comprises a second switching element, wherein the hydraulic actuating means comprise a first control unit for actuating the first valve and a second control unit for actuating the second valve, at least one of the control units comprising:

a control cylinder having a control piston and a primary connection, an actuating element which is designed to be driven by the control piston, in order to actuate the switching element of the respective valve as a function of the position of the control piston, and wherein a hydraulic control connection forms a connection between the primary connection and the secondary connecting line.

11. The hydraulic actuating device according to claim 10, wherein the switching element is a ball.

12. The hydraulic actuating device according to claim 10, wherein the actuating element is a piston rod which is connected to the control piston.

* * * * *